United States Patent [19]

Martini

[11] 4,269,556

[45] May 26, 1981

[54] STACK CHANGING APPARATUS

[75] Inventor: Norbert Martini, Erkrath, Fed. Rep. of Germany

[73] Assignee: Jagenberg Werke Aktiengesellschaft, Dusseldorf, Fed. Rep. of Germany

[21] Appl. No.: 972,304

[22] Filed: Dec. 22, 1978

[30] Foreign Application Priority Data

Dec. 27, 1977 [DE] Fed. Rep. of Germany ..... 2758291

[51] Int. Cl.[3] ..... B65H 31/32; B65H 31/10

[52] U.S. Cl. ..... 414/50; 271/218; 414/43; 414/101

[58] Field of Search ..... 271/218, 217, 219, 215, 271/213; 414/101, 102, 50, 43

[56] References Cited

U.S. PATENT DOCUMENTS

| | | | |
|---|---|---|---|
| 3,131,819 | 5/1964 | Ducayet | 271/213 X |
| 4,111,411 | 9/1978 | Graves et al. | 271/218 X |

*Primary Examiner*—Bruce H. Stoner, Jr.

*Attorney, Agent, or Firm*—Sprung, Felfe, Horn, Lynch & Kramer

[57] ABSTRACT

In a stack changing apparatus for sheet ejecting machines having a drop table vertically movable within a first frame structure, the drop table having a pallet to be placed thereon for receiving stacks; and a second vertical frame structure provided behind the first vertical frame structure having a carriage which is movable vertically and parallel to the drop table and, provided with pallet transport elements, is also horizontally movable between the second and the first frame structure, the improvement wherein one of two stacking platforms is alternatively used as the drop table, the platforms being selectively movable to one of the two sides of the first vertical frame structure and their stacking surfaces being below the level of the floor, the apparatus being further provided with an auxiliary skid for each stacking platform, the height of the auxiliary skid being such that when on a stacking platform the top of the skid is substantially level with the floor, each auxiliary skid having take-up elements for the pallet transport elements which can be lowered down to below the level of the floor.

1 Claim, 9 Drawing Figures

STACK CHANGING APPARATUS

The present invention relates to a stack changing apparatus for sheet ejecting machines with a drop table movable vertically within a first frame structure and a pallet mountable thereon for receiving the stacks, and a second vertical frame structure provided behind the first vertical frame structure, wherein a carriage is movable vertically and parallel to the drop table and, provided with pallet transport elements, is horizontally movable between the first and the second frame structure.

An apparatus of this type is known for the process of automatically changing stacks of paper. The prior art apparatus is described in more detail with reference to FIGS. 1 and 2. In general, the known apparatus allows for the high speeds of modern cross cutters, so standstill times while changing the stacks are kept to a minimum. However, difficulties are always encountered when different sizes of pallets are to be placed onto the drop table. Firstly, there is the problem of placing the pallet on the drop table, when different formats and sizes are used, such that a fork lift is capable of transporting the pallet easily out of the first vertical frame structure, and accordingly, of supplying a new empty pallet. Secondly, the pallet must be located such that it can be received by the pallet transport elements of the carriage in the second vertical frame structure. However, since pallets come in different sizes and are accordingly used, it becomes necessary to align the pallet transport elements of the carriage with the take-up elements of the respective pallet. To this end, the pallet transport elements of the carriage, e.g. two or four forks, are slidably provided perpendicular to the direction of the paper feed. Additional work and time is spent on such alignments and in practice, it is often possible that pallets are used which do not have suitable take-up elements for the pallet transport elements. Thus, there are disadvantages in the use of the known stack changing apparatus with respect to transporting the pallets into and out of the first vertical frame structure, and also with respect to transferring the empty pallet to the take-up elements of the carriage.

It is therefore an object of the present invention to provide an apparatus for changing stacks of paper automatically, ensuring a rapid stack exchange regardless of the size and format of the pallets used.

The object of the present invention is realized in the stack changing apparatus according to the present invention by providing two stacking platforms which are alternatively used as a drop table and which are movable perpendicularly and selectively into one of the two sides of the first vertical frame structure, their stacking area being below floor level by the height of an auxiliary skid mountable thereon, and the auxiliary skids having take-up elements for the pallet transport elements which can be lowered down to below the floor level. Instead of a known drop table, this structure has two stacking platforms which are transversely movable on rails for example and receptive of auxiliary skids. The two stacking platforms are provided below the floor level such that they will become flush with the floor by the addition of the auxiliary skids which are placed on same. In comparison with the prior art system, the entire structure is thus below floor level by the height of an auxiliary skid, in the area of the two vertical frame structures. In combination therewith, two stacking platforms are provided which are movable on rails, for example, transversely to the first vertical frame structure. The auxiliary skids are advantageously of lightweight construction and have take-up elements for the transport elements of the carriage. If, for example, the carriage has two or four forks as transport elements, guides are advantageously provided in the auxiliary skids for receiving the forks. The auxiliary skids remain in the area of the movable stacking platforms or in the area of the pallet transport elements of the carriage. Thus, the pallet transport within the area of the two vertical structures is determined by the spatial shape of the auxiliary skid while the pallet transport outside of the vertical frame structure is effected by means of fork lifts, in a manner well known in the art. There are no difficulties in transporting to and away from the structure according to the invention since the stacking area of the auxiliary skids is even with the floor, thus making the auxiliary skids accessible from three sides from outside of the vertical frame structure. The structure according to the invention permits the optimum transport of the pallets to and fro when these pallets are of different format and size, since the auxiliary skid which is flush with the floor eliminates all of the problems which are encountered in known structures when the pallet is to be received by the transport elements of the carriage located in the second frame structure. The structure according to the invention permits an operation wherein the transport function of the pallet within the vertical frame structures is clearly separated from the transport function of the pallet by means of fork lifts and on the outside of the claimed structure.

The apparatus according to the invention is further described in detail with reference to the drawings, wherein.

Figure 1:
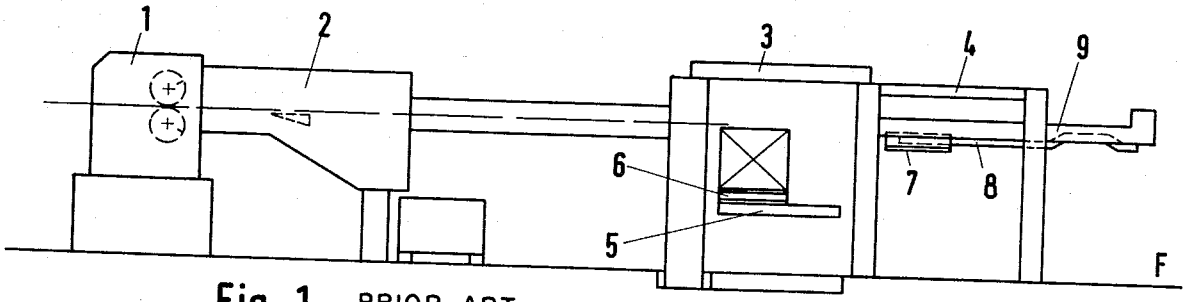
Fig. 1 PRIOR ART
FIG. 1 is a side view and FIG. 2 is a top view of a prior art structure.
Figure 2:
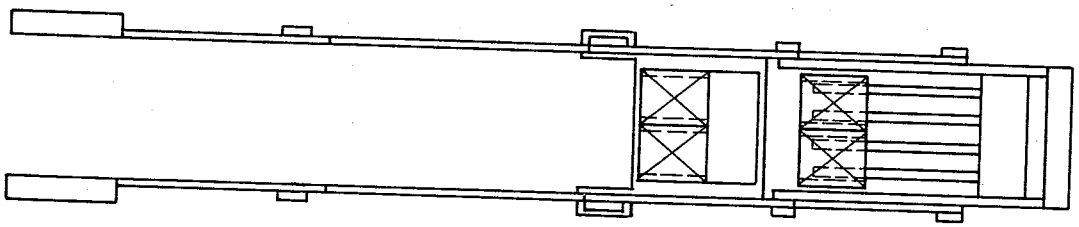
Fig. 2 PRIOR ART

The known structure shown in FIGS. 1 and 2 has a cross cutter 1, a chamber 2, a first vertical frame structure 3 and a second vertical frame structure 4 arranged in a line in the direction of the paper feed. The drop table 5 and the pallet 6 mountable thereon are provided within the first vertical frame structure 3. The drop table 5 with its pallet 6 is in the stacking position while the stacking height is nearly reached. Within the second vertical frame structure 4, there is an empty change pallet 7 in waiting position, resting on the take-up elements 8 of carriage 9. The carriage 9 can be lowered downwardly within the second vertical frame structure to about floor level F such that take-up elements 8 can receive an empty change pallet from floor level F. The take-up elements 8 are movable within two horizontal guides of carriage 9 horizontally between the first vertical frame structure 3 and the second vertical frame structure 4.

The method of operation of the known apparatus is as follows:

As soon as the stacking height is reached in the first vertical frame structure 3, the drop table with the pallet 6 mounted thereon moves vertically downwardly and the change pallet 7 moves into the first vertical frame structure 3 by means of the take-up elements 8 from the second vertical frame structure 4. During this pallet exchange, a gap in the flow of sheets of paper is brought about by reducing the paper feed speed and, if necessary, by means of the channel. As soon as the change pallet 7 has reached the stacking position in the first vertical frame structure 3, the normal paper feed speed can be resumed. The function of the drop table is now temporarily assumed by the carriage 9, the take-up elements 8 and the change pallet 7. In the meantime, the lowered pallet 6 is removed together with the finished stack from the first vertical frame structure 3 by means of fork lifts, such that the drop table 5 is subsequently movable vertically and upwardly under the change pallet 7. The drop table 5 resumes its function such that the take-up elements 8 and the carriage 9 are again available for transporting another change pallet. This empty new change pallet is received by the take-up elements 8 below the drop table 5 in position in the first vertical frame structure 3. Difficulties are here encountered when different sizes of pallets are supplied or when the pallets are not provided with suitable receiving elements which ensure the transport by means of fork lifts as well as the transport by means of the take-up elements 8 of the carriage 9.

Figure 5:
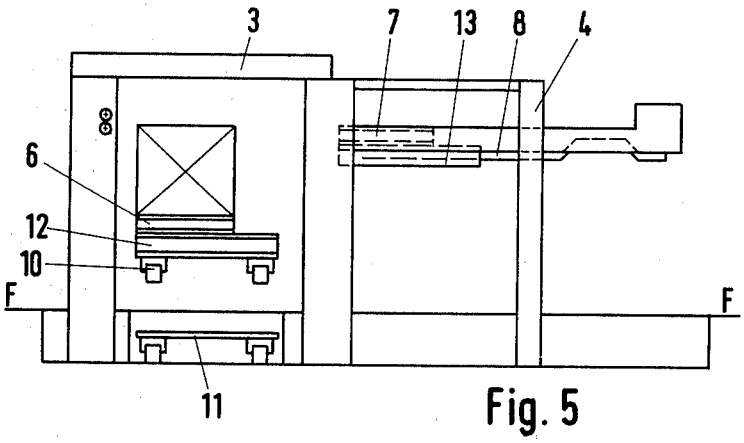
Figure 6:
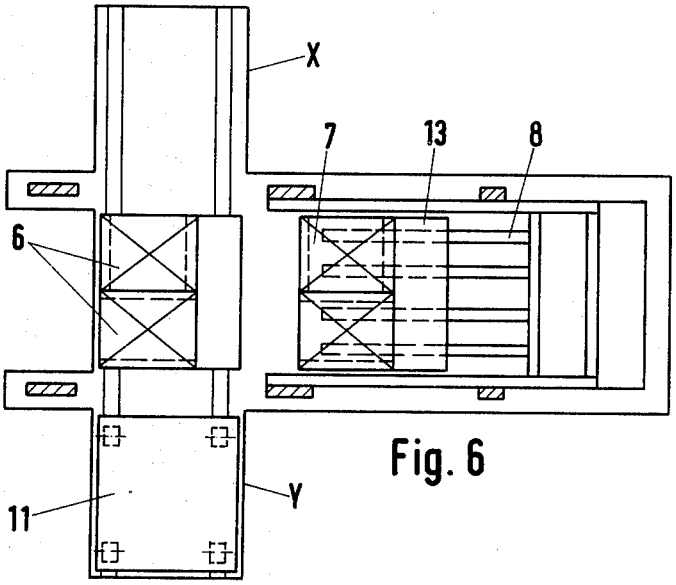
Figure 7:
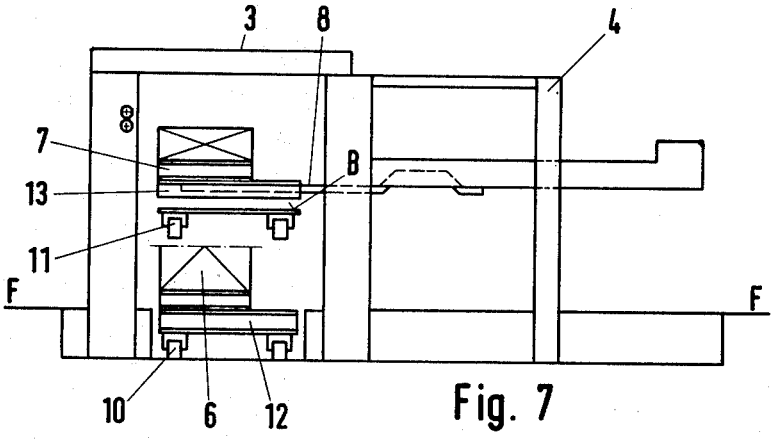
Figure 8:
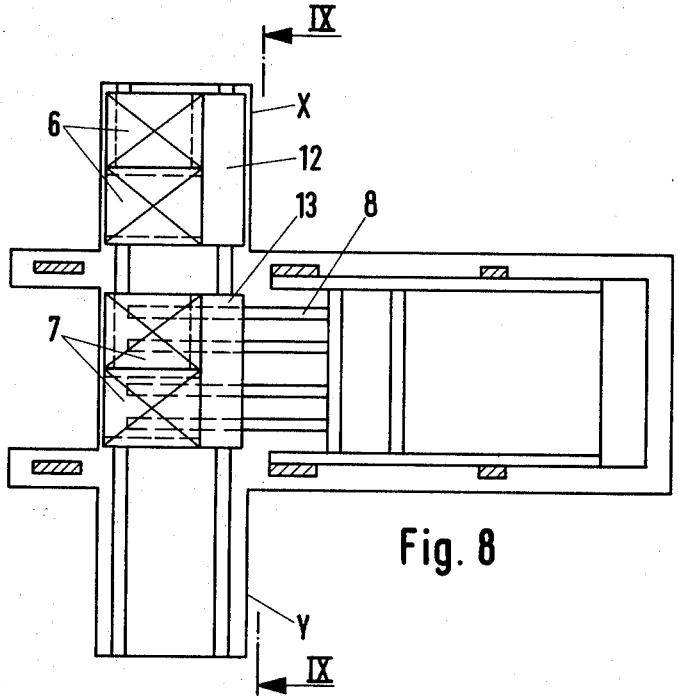

The structure according to the invention as shown in FIGS. 3–9 is essentially distinguished from the above described structure by the following features:

Instead of a drop table, there are provided in the first vertical frame structure 3 two movable stacking platforms 10, 11 which are movable for example on rails transversely to the frame structure. The stacking platform 10 has a stacking surface A and the stacking platform 11 has a stacking surface B. In the lowest position of the stacking platform 10,11, the level of the respective stacking surface A and B is below the floor level F by the height of an auxiliary skid 12, 13 mountable thereon, such that the floor level F is reached when the auxiliary skids 12 and 13 respectively are set in place. As shown in FIGS. 3–8, the recess below floor level extends beyond the second vertical frame structure 4 such that the carriage 9 with its take-up forks 8 is also vertically movable below the floor level F. The take-up forks 8 do not receive the pallet directly but the auxiliary skids 12 and 13 which are placed upon the stacking surfaces A and B respectively. Each auxiliary skid 12, 13 is of lightweight construction and has guides 14 (cf. FIG. 9) for receiving the take-up forks 8. The top views of FIGS. 4, 6 and 8 illustrate that each stacking platform 10, 11 adjacent to the first vertical frame structure 3 is selectively movable to the respectively free space into a position X or a position Y respectively. When the auxiliary skids 12 and 13 are placed upon the stacking surface A and B respectively, the surface of the auxiliary skid 12 and 13 will form a flush surface with the floor level F. Pallets 6 and 7 can thus, without difficulties, be set onto the surface of the auxiliary skids 12 and 13 respectively by means of fork lifts. The auxiliary skids 12 and 13 respectively, on the same level with the floor F, is then accessible from three sides in position X or Y by means of a fork lift such that there are no problems with respect to the transport of pallets 6,7.

Figure 3:
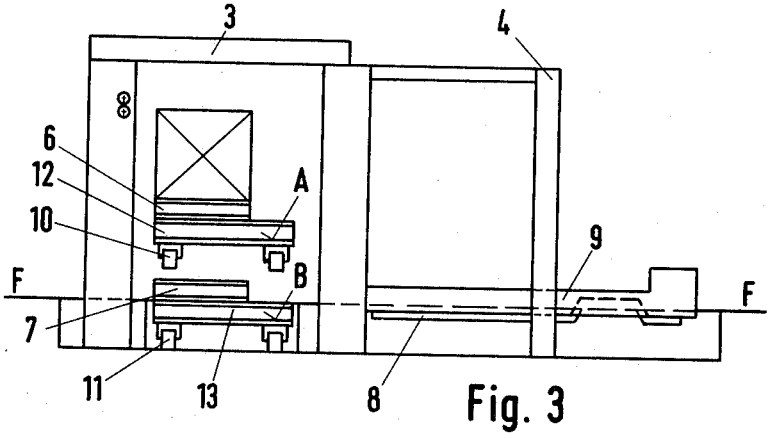
FIGS. 3–8 illustrate in side views (e.g., FIGS. 3, 5 and 7) and top views (e.g., FIGS. 4, 6 and 8) respectively the operation of the structure according to the invention at different times of operation.
Figure 4:
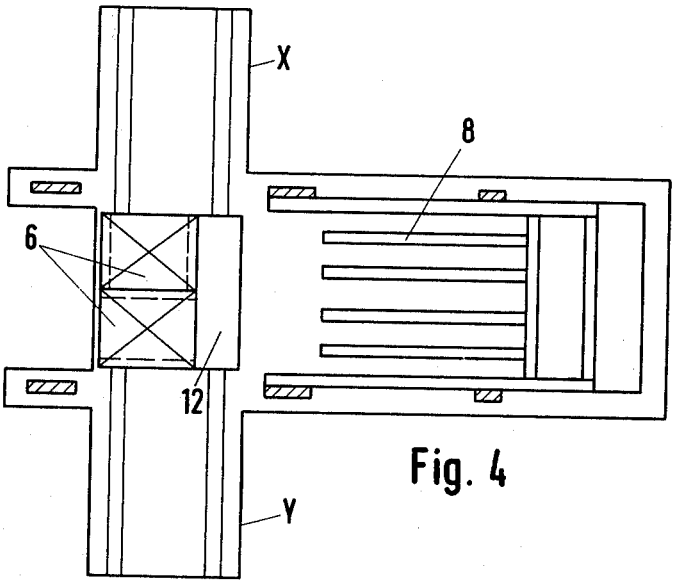

In the following, the operation of the apparatus according to the invention is described at different time intervals:

In the operation shown in FIGS. 3 and 4, the stacking platform 10 with the auxiliary skid 12 placed onto the surface A and the pallets 6 resting on the auxiliary skid 12 is in a stacking position while more than half the stacking height is already reached. Coming from position X, there is a second stacking platform 11 arranged in the first vertical frame structure, the auxiliary skid 13 being placed upon its stacking surface B. There are two empty change pallets 7 on the auxiliary skid 13 which were deposited by a forklift in position X onto the auxiliary skid 13. The surface of the auxiliary skid 13 is level with the level of the floor F. To prepare the exchange of pallets, the carriage 9 in the second vertical frame structure 4 moves with its take-up forks 8 down to below the floor level F such that the take-up forks 8 take up the auxiliary skid 13 by moving horizontally into the first vertical frame structure. The change pallets 7 are thus transported indirectly through the taking of the auxiliary skid 13 into the second vertical frame structure 4 and from there vertically upwardly. Simultaneously, the stacking platform 11 from the first vertical frame structure 3 is moved transversely into position Y such that the necessary conditions for a rapid stack change are created for the stacking platform 10 located in stacking position. The situation shortly before the stack exchange is shown in FIGS. 5 and 6. The stacking platform 11 and the auxiliary skid 13 with the change pallets 7 resting on the forks 8 are in waiting position. As soon as the pre-selected stacking height is reached on pallets 6 of the stacking platform 10, a gap is introduced in the paper sheet flow by reducing the speed. The necessary steps, such as the reduction of the speed at the cross cutter and the opening of a channel are known in the art. As soon as the sheet gap reaches the stacker, the stacking platform 10 moves downwardly with the finished stack, and by means of the forks 8, the auxiliary skid 13 with change pallets 7 is moved into the stacking position. While the cross cutter accelerates again to the originally set speed, the new sheets are now received by the pallets 7 on the auxiliary skid 13, held by forks 8. The stacking platform 10 with the finished stack can be lowered down to the rails and then be moved transversely from the first vertical frame structure 3 into the empty position X. From position Y, the stacking platform 11 with the stacking surface B is movable into the first vertical frame structure 3 (FIGS. 7 and 8). Now the stacking platform 11 and its surface B is moved under the auxiliary skid 13 such that the forks can be moved back into the starting position in the second vertical frame structure 4. Simultaneously, in position X, the finished stack can be removed from the stacking platform 10. For this purpose, a fork lift moves toward the auxiliary skid 12 being flush with the floor level and receives pallets 6 with the finished stack. Subsequently, new empty pallets are placed in stacking position onto the auxiliary skid 12.

Even with the most different pallet shapes, the described arrangement poses no problems since the auxiliary skids 12 and 13 which are flush with floor level F are accessible from three sides by fork lifts in their positions X and Y respectively, and on the other hand, the shape of the pallets does not impair the pallet exchange within the two vertical frame structures since this is dependent only upon the auxiliary skids 12 and 13 respectively which are flush with the floor level F.

Figure 9:
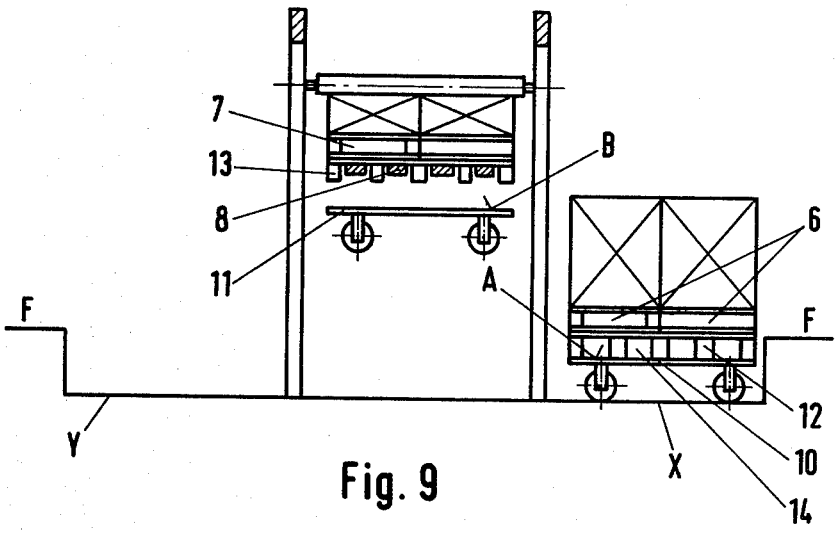
FIG. 9 is a vertical sectional view along line IX—IX of FIG. 8.

This becomes very clear in the vertical sectional view along lines IX—IX of FIG. 8. FIG. 9 shows that the auxiliary skid 12 is flush with the floor level F where the skid 12 is placed onto the surface A of the stacking platform 10. Below the floor level F, the auxiliary skid 12 which is of lightweight construction has four guides 14 for taking up the four forks 8 of the carriage. As shown in FIG. 9, the pallets 6 provided with the stacks can be removed from the right without any problems by means of a fork lift movable at floor level. Should it not be possible to approach the pallet from the right on the outside, there are the two lateral sides of position X since the pallets 6 on the auxiliary skid are accessible from three sides.

It will be appreciated that the instant specification is set forth by way of illustration and not limitation, and that various modifications and changes may be made without departing from the spirit and scope of the present invention.

What is claimed is:

1. In a stack changing apparatus for sheet ejecting machines having a drop table vertically movable within a first frame structure defining a stacking position, the drop table having a pallet to be placed thereon for receiving stacks, and a second vertical frame structure provided behind the first vertical frame structure in the direction of flow of the sheets and having a carriage which is movable vertically and parallel to the drop table and provided with pallet transport elements, is also horizontally movable between the second and the first frame structure, the improvement wherein one of two stacking platforms is alternatively used as the drop table, the first frame structure has means disposed on the sides of the stacking position perpendicular to the direction of sheet flow for movably receiving the stacking platforms, the platforms being selectively movable transversely to one of the two sides of the first vertical frame structure and their stacking surface being below the level of the floor, the apparatus being further provided with an auxiliary skid for each stacking platform, in claim 1, line 20 the auxiliary skid resting on top of the platform and the pallet resting on top of the auxiliary skid, the height of the stacking platform being such that when an auxiliary skid is placed on top of the stacking platform the top of the skid is substantially level with the floor, each auxiliary skid having take-up elements for engagement by the pallet transport elements and wherein the pallet transport elements are mounted to be lowered down to below the level of the floor to engage an auxiliary skid for lifting the auxiliary skid and the pallet resting thereon from atop the platform for movement of the skid and the pallet to the stacking position to effect stack changing.

* * * * *

UNITED STATES PATENT AND TRADEMARK OFFICE

CERTIFICATE OF CORRECTION

PATENT NO. : 4,269,556

DATED : May 26, 1981

INVENTOR(S) : Norbert Martini

It is certified that error appears in the above-identified patent and that said Letters Patent are hereby corrected as shown below:

Column 6, line 10 Delete "in Claim 1, line 20".

Signed and Sealed this

*Twenty-seventh* Day of *October 1981*

[SEAL]

*Attest:*

GERALD J. MOSSINGHOFF

*Attesting Officer*

*Commissioner of Patents and Trademarks*